US005480338A

United States Patent [19]

Barthold

[11] Patent Number: 5,480,338

[45] Date of Patent: Jan. 2, 1996

[54] LUMINESCENT SCREEN IMAGE MAKING TOY

[75] Inventor: Mark J. Barthold, Redondo Beach, Calif.

[73] Assignee: Mattel, Inc., El Segundo, Calif.

[21] Appl. No.: 385,618

[22] Filed: Feb. 9, 1995

[51] Int. Cl.[6] ..... A63H 33/22

[52] U.S. Cl. ..... 446/219; 446/485; 434/81

[58] Field of Search ..... 446/219, 485; 434/81; 40/442; 273/310

[56] References Cited

U.S. PATENT DOCUMENTS

| | | | |
|---|---|---|---|
| 2,225,307 | 12/1940 | Kreeger | 446/219 X |
| 2,460,221 | 1/1949 | Gordon | 250/483.1 |
| 2,705,675 | 4/1955 | Bixby | 361/229 |
| 3,030,856 | 4/1962 | Jordan | 446/219 X |
| 3,707,055 | 12/1972 | Pearce | 446/485 |
| 3,796,869 | 3/1974 | Stone | 362/84 |
| 4,461,117 | 7/1984 | Gott | 446/485 X |
| 4,530,035 | 7/1985 | Kawarada | 362/184 X |
| 4,748,366 | 5/1988 | Taylor | 446/485 X |
| 4,779,166 | 10/1988 | Tanaka et al. | 362/84 X |
| 4,782,432 | 11/1988 | Coffman | 362/184 |
| 4,789,371 | 12/1988 | Boggs et al. | 446/219 |
| 4,891,032 | 1/1990 | Davis | 446/485 X |
| 5,021,931 | 6/1991 | Matsui et al. | 362/84 |

FOREIGN PATENT DOCUMENTS

| | | | |
|---|---|---|---|
| 2224661 | 5/1990 | United Kingdom | 446/219 |

*Primary Examiner*—Mickey Yu
*Attorney, Agent, or Firm*—Roy A. Ekstrand

[57] ABSTRACT

A luminescent screen image making toy includes a generally planar luminescent screen having a luminescent surface defined thereon. A light unit includes an elongated housing supporting a directed light beam source and a strobe light unit. The strobe light unit and directed light beam source are constructed in accordance with conventional fabrication techniques and are utilized in providing either large are short duration illumination of the luminescent surface of the screen or small area light spot illumination suitable for writing or drawing activities.

8 Claims, 2 Drawing Sheets

LUMINESCENT SCREEN IMAGE MAKING TOY

FIELD OF THE INVENTION

This invention relates generally to toy apparatus using various light sources and particularly to toys utilizing luminescent materials.

BACKGROUND OF THE INVENTION

A great many toys and toy devices have been produced through the years which utilize some source of light or which interact with light in some manner. Various flash lights and simulated strobe lights or the like have been provided by toy manufacturers. One of the more interesting materials which has intrigued toy manufacturers is that found in materials which are generally described as "luminescent". Luminescent materials are often described as "glow-in-the-dark" materials due to their property of storing illuminating energy received from an external source and thereafter glowing or emitting a subdued light for an extended period of time. Various types of games and toy apparatus attempting to make use of the amusing and interesting properties of luminescent materials have been provided. For example, an early device is found in U.S. Pat. No. 2,460,221 issued to Gordon which sets forth a LUMINESCENT AMUSEMENT DEVICE having a multipaged book-like structure utilizing a back page formed of a luminescent material and a plurality of transparent covering pages. A number of silhouette-type objects are provided representing animals or humans in different positions. The objects are placed upon the luminescent page and covered by the transparent pages to be held in place. Thereafter, the apparatus is exposed to a light source and the objects are removed. Thereafter, the device when viewed in subdued or darkened room conditions glows and defines a darkened silhouette of the previously exposed objects.

U.S. Pat. No. 2,225,307 issued to Kreeger sets forth a CONVERTIBLE PICTURE used for displaying objects which appear differently under different light conditions such as normal light, darkness or dim light. The structure includes a transformation by means of luminescent applications which respond differently to different lighting conditions.

U.S. Pat. No. 2,705,675 issued to Bixby sets forth a PLATE CHARGING CIRCUIT FOR ELECTROPHOTOGRAPHY having a photoexposing apparatus which utilizes a light responsive electric palette upon which a variety of objects are placed. Exposure with a suitable light source causes a charging of the palette in areas not covered by the object producing a photoelectric plate.

U.S. Pat. No. 3,030,856 issued to Jordan sets forth a KALEIDOSCOPE PROJECTING APPARATUS in which a light source and lens system are applied to a plurality of rotatably supported image bearing disks interposed between the light source and a display screen. As the image bearing disks are moved in a kaleidoscope-like action, the projected image upon the screen is correspondingly altered.

U.S. Pat. No. 3,707,055 issued to Pearce sets forth an ILLUMINATED MAGIC WAND having a handle portion supporting an extending translucent stem portion. A battery supply and electric light bulb is supported within the handle such that light produced by the electric lamp is directed into the translucent stem portion to provide an illuminated or glowing stem portion for the toy wand.

U.S. Pat. No. 4,461,117 issued to Gott sets forth a TOY GRENADE WITH FLASH CUBE having a housing which receives and supports a self-powered camera flash cube. A switch is supported upon one end of the housing and electrically coupled to an impact mechanism and to the flash cube. A plurality of directing fins are supported on the reverse side of the housing to ensure that the grenade when thrown impacts on the impact sensing end and activates one cell of the flash cube to produce a burst of light as the grenade impacts.

U.S. Pat. No. 4,891,032 issued to Davis sets forth a FLEXIBLE TOY WAND having a battery case at its lower end which also serves as the handle of the wand and a decorative lightable end piece at the opposite end of the wand. The wand is waved in a darkened area and various paths of light are created by the movement of the lighted end piece.

U.S. Pat. No. 4,789,371 issued to Boggs, et al. sets forth a SIMULATED TOY FLASH CAMERA having a flash housing containing a light reflecting member visible through a front opening in the frontal wall of the flash housing. A flash shutter mechanism is provided and is operative together with a light source and reflector to produce a burst of light energy through the flash unit to simulate a flash bulb.

U.S. Pat. No. 3,796,869 issued to Stone sets forth a SELF ILLUMINATED CASE having a flash light housing, a universal mounting and an internal switch therein. A lightbulb within the housing energizes a phosphorescent band of luminosity to produce a regenerated image on the housing.

U.S. Pat. No. 4,530,035 issued to Kawarada sets forth an ELECTRONIC FLASH APPARATUS having a plurality of flash light projectors comprising flash discharge tubes and reflecting shades therefor. The flash discharge tubes are juxtaposed in an opening to produce a source of flash light.

U.S. Pat. No. 4,782,432 issued to Coffman sets forth a MULTIFUNCTION LIGHT forming a portable illuminating device having plural lamps such as a spotlight, a fluorescent lamp and a strobe light disposed within a housing and selectively connected to a rechargeable battery. A remote magnetically operated switching mechanism is provided to permit the housing to be waterproof.

U.S. Pat. No. 4,748,366 issued to Taylor sets forth NOVEL USES OF PIEZOELECTRIC MATERIALS FOR CREATING OPTICAL EFFECTS for use in an article of manufacture such as a toy or ball or the like. A piezoelectric element for generating electrical energy in response to movement of the article is combined with an optical device such as a neon bulb or the like and electrically connected thereto to provide an electrically operated light in response to electrical energy provided by movement of the piezoelectric device.

U.S. Pat. No. 4,779,166 issued to Tanaka, et al. sets forth an ILLUMINATING APPARATUS comprising a plane board composed of a transparent resin having an organic fluorescent dye incorporated therein and a light reflecting member arranged on at least a part of the back surface of the plate board is emitted from the plate board surface.

U.S. Pat. No. 5,021,931 issued to Metsui, et al. sets forth a LENTICULAR LUMINESCENT SCREEN having a lenticular base plate made of transparent material which contains a substance capable of emitting luminescent light in response to stimulating light applied thereto.

British Patent 2,224,661 issued to Cimock sets forth a LIGHTED WAND TOY having an elongated transparent enclosure incorporating randomly distributed reflective pieces for reflecting light from a bulb supported within the enclosure.

While the foregoing described prior art devices have provided entertaining, amusing and useful apparatus, there remains nonetheless a continuing need in the art for evermore improved image making toys.

SUMMARY OF THE INVENTION

Accordingly, it is a general object of the present invention to provided an improved image making toy. It is a more particular object of the present invention to provide an improved image making toy utilizing the interesting properties of luminescent materials.

In accordance with the present invention, there is provided a luminescent image making toy comprises: a luminescent screen defining a luminescent image surface; a light unit housing defining an interior cavity; strobe light means for producing a short-duration burst of light energy supported within the interior cavity; a strobe trigger coupled to the strobe light means; directed light means for producing a long duration directed beam of light energy supported within the interior cavity; and a directed light control button for operating the directed light means.

BRIEF DESCRIPTION OF THE DRAWINGS

The features of the present invention, which are believed to be novel, are set forth with particularity in the appended claims. The invention, together with further objects and advantages thereof, may best be understood by reference to the following description taken in conjunction with the accompanying drawings, in the several figures of which like reference numerals identify like elements and in which:

DESCRIPTION OF THE PREFERRED EMBODIMENT

Figure 1:
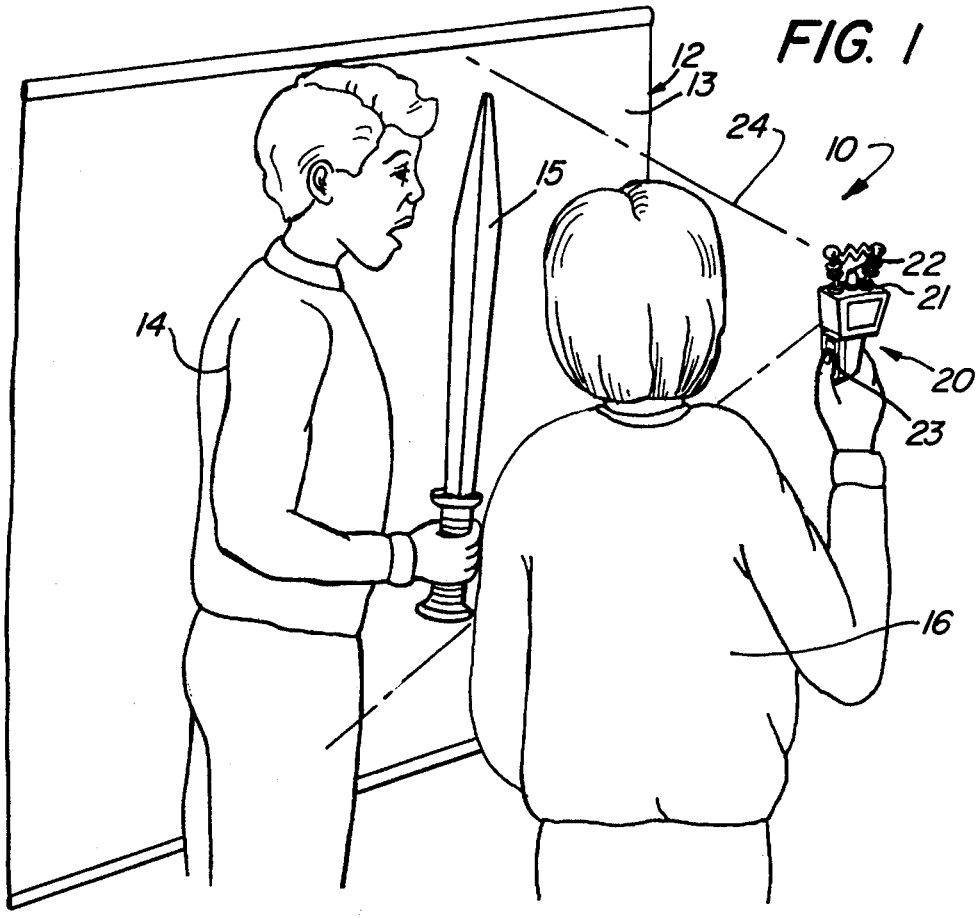
FIG. 1 sets forth a perspective view of the present invention image making toy used in a silhouetting mode.

FIG. 1 sets forth a perspective view of an image making toy constructed in accordance with the present invention and generally referenced by numeral 10. Image making toy 10 includes a luminescent screen 12 defining a generally planar luminescent surface 13. Luminescent surface 13 may be fabricated using virtually any luminescent material of the type known in the prior art with the essential property being the capability of luminescent surface 13 to absorb light energy and to reradiate or luminesce the light energy absorbed at a slow preferably long duration rate. Luminescent screen 12 is supported upon a convenient wall surface (not shown) using conventional fabrication techniques (not shown). Image making toy 10 further includes a handheld light unit 20 having a housing 21. As is set forth below in FIGS. 3 through 5 in greater detail, light unit 20 includes means for producing a strobe light flash as well as means for producing a directed light beam at the choice of the user. Suffice it to note here in the manner in which light unit 20 is utilized in FIG. 1 that housing 21 includes a conventional photo strobe type unit coupled to a strobe trigger button 23. A strobe indicator 22 provides visual indication of the completion of a strobe cycle within light unit 20 and the availability of a strobe light burst once strobe trigger button 23 is pushed. As is better seen in FIG. 3, light unit 20 includes a strobe lens 50 on the frontal facet thereof which distributes the burst of strobe light energy provided by strobe circuit 55 (seen in FIG. 5) in combination with strobe discharge tube 51 (seen in FIG. 4).

In the anticipated play pattern, player 16 holds light unit 0 such that the front face supporting strobe lens 50 (seen in FIG. 3) is generally directed toward luminescent screen 12. Thereafter, player 16 interposes virtually any object or objects of choice between light unit 20 and luminescent surface 13 of screen 12. In the example shown in FIG. 1, a cooperating player 14 holding a sword 15 is positioned between light unit 20 and luminescent surface 13. At the desired time, player 16 simply depresses strobe trigger button 23 energizing the strobe unit within light unit 20 and producing a burst of short duration high intensity strobe light 24 which illuminates the general area in front of player 16 including luminescent surface 13. The interposition of player 14 holding sword 15 provides an interposing opaque structure between light unit 20 and luminescent surface 13 causing the surrounding portion of luminescent surface 13 to be illuminated or energized while the portions of surface 13 behind player 14 and sword 15 are not energized.

Figure 2:
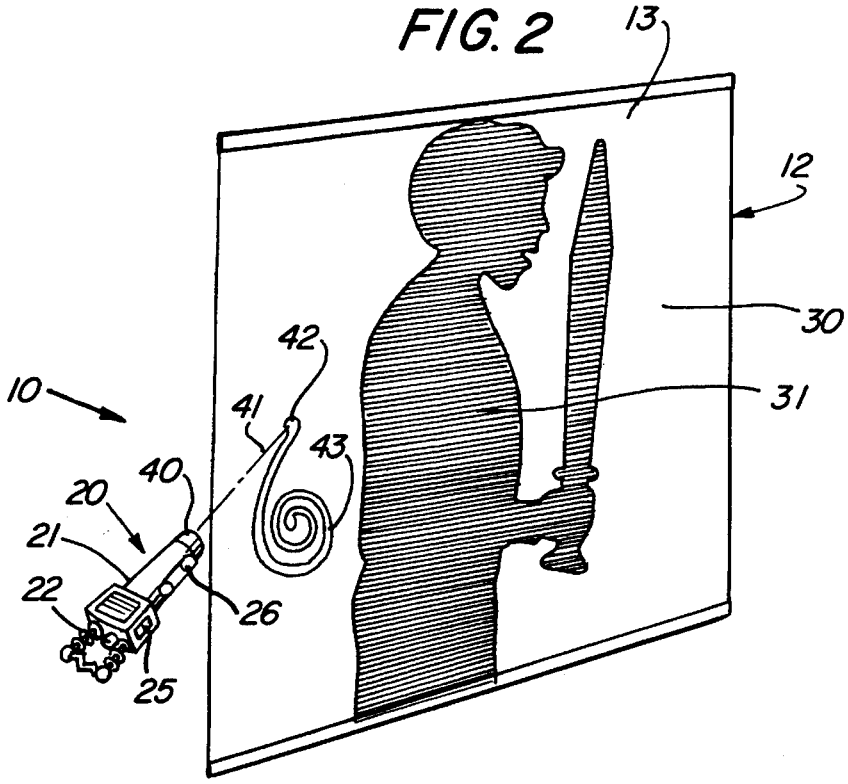
FIG. 2 sets forth a perspective view of the exposed luminescent screen of the present invention together with the present invention being used in a writing or drawing operation.

FIG. 2 sets forth a front perspective view of the present invention image making toy following the silhouetting exposure described above in FIG. 1. As can be seen, luminescent screen 12 defines luminescent surface 13 which in turn provides a glowing area 30 surrounding a darkened silhouette 31 which corresponds to the profile of player 14 and sword 15 (seen in FIG. 1) presented to strobe light 24 as light unit 20 is actuated in the strobe light mode. As a result, luminescent screen 12 glows for a substantial period of time in glowing area 30 while darkened silhouette 31 maintains the image imposed upon screen 12 in the above-described image making process. While the present invention image making toy may be operated satisfactorily in subdued light or slightly darkened environment, the effectiveness and enjoyment of the present invention image making toy is greatly enhanced by participation in a substantially dark or thoroughly dark environment. The image resulting from the above exposure is maintained upon luminescent screen 12 as a darkened silhouette 31 surrounded by a glowing area 30 for a period of time determined substantially by the characteristics of luminescent material used in forming luminescent surface 13. Essentially, as the luminescent material of surface 13 continues to radiate light energy or "glow-in-the-dark", the energy thereof is at some point depleted and glowing area 30 begins to also darken reducing the apparent darkness of silhouette 31. At some point, glowing area 30 substantially ceases to provide light energy and the overall appearance of luminescent screen 12 is that of a darkened screen as the appearance of silhouette 31 diminishes and eventually disappears.

In accordance with a further aspect of the present invention, light unit 20 may be further utilized to provide a second amusing and entertaining operation of the present invention image making toy. As described above, light unit 20 includes an elongated housing 21 supporting a strobe indicator 22. Light unit 20 further includes an on/off button 25 and a light beam 26. A directed light beam source 40 (better seen in FIGS. 3 and 5) is supported at the lower end of housing 21 and upon actuation of light beam button 26 produces a substantially narrow well defined directed light beam 41.

The direction of light beam 41 toward luminescent surface 13 of screen 12 produces a light spot 42 at the point of impact of light beam 41 against luminescent surface 13. As described above, the luminescent material of surface 13 absorbs light energy from an illuminating source and thereafter continues to reradiate or luminesce light energy for an extended period of time following illumination. Accordingly, as light unit 20 is manipulated to move the impact point or light spot across surface 13 of screen 12, a bright trail 43 is created upon luminescent surface 13. The high intensity and generally focused character of light beam 41 provides a substantial amount of light energy at the point of impact (light spot 41) and thus bright trail 43 tends to glow for a substantial period of time. Thus, with all or part of luminescent surface 13 either dark or partially lighted, the user is able to "write or draw" upon luminescent surface 13 using directed light beam 41 as a writing or drawing instrument.

Thus, the user is able to alternatively provide silhouettes of various objects against surface 13 of luminescent screen 12 or, alternatively, to write or draw upon luminescent surface 13 at the user's choice. Of course, it will be recognized that various combinations of activities which utilize both the strobe light capability as well as directed light beam capability of light unit 20 may be employed by the user to enhance play and amusement value.

In accordance with a further advantage of the present invention, the user may employ the strobe light portion of light unit 20 to provide a convenient "eraser" for luminescent surface 13. Thus, as a variety of images accumulate at varying levels of luminescence upon luminescent screen 12, the user may essentially clear the accumulated images by simply firing the strobe light portion of light unit 20 unobstructed against luminescent surface 13. The intense high duration energy of the strobe unit brings the entire luminescent screen to maximum illumination and equalizes the entire screen surface in a generally uniform illumination removing traces and accumulations of prior imaging. Thereafter, as luminescent screen 12 glows and decays, a generally uniform darkened surface is available to the user for additional imaging.

Figures 3, 4, 5:
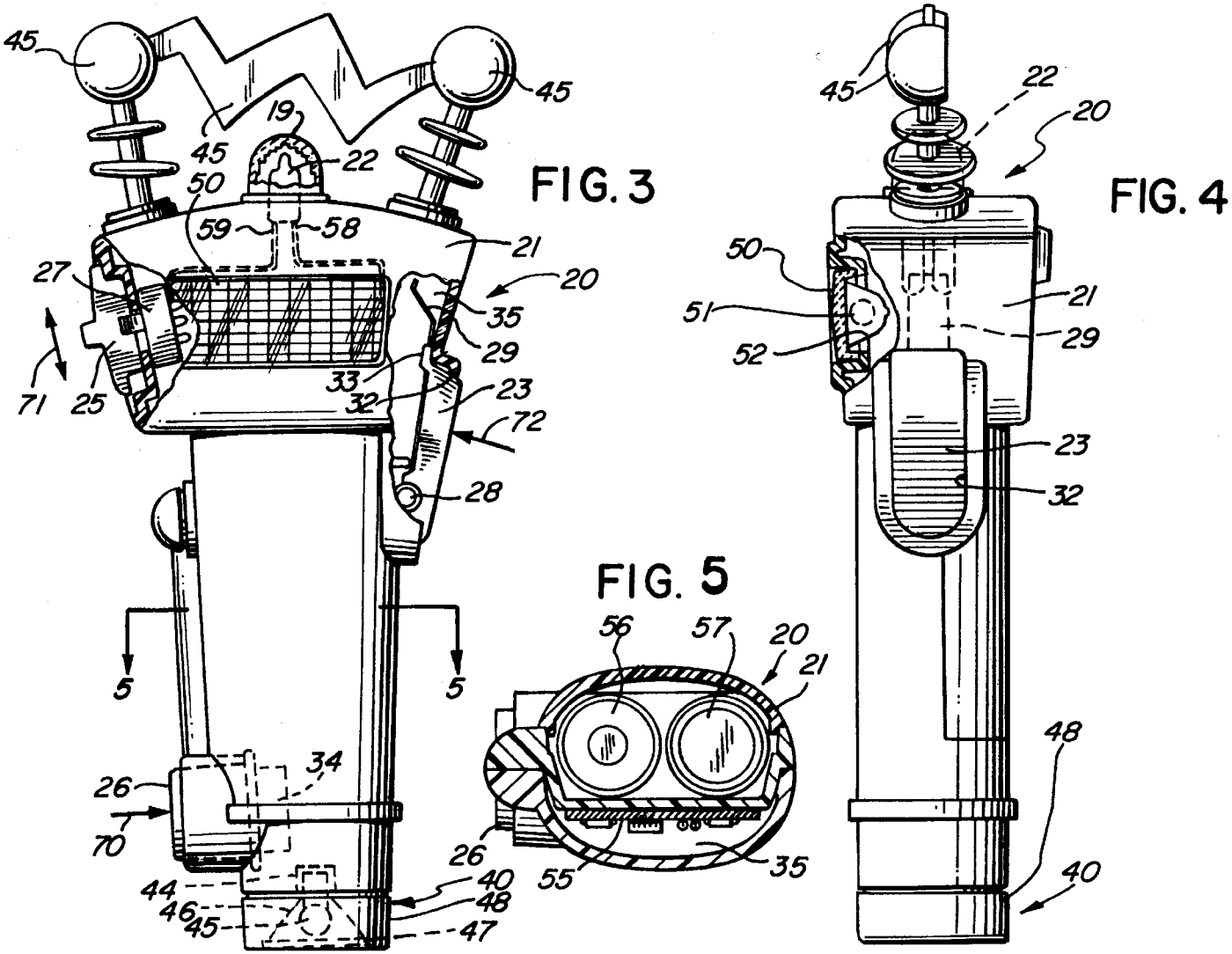
FIG. 3 sets forth a partially sectioned front view of the light source apparatus of the present invention.
FIG. 4 sets forth a partially sectioned side view of the light source of the present invention.
FIG. 5 sets forth a section view of the light source apparatus of the present invention taken along section lines 5—5 in FIG. 3.

FIGS. 3, 4 and 5 set forth more detailed views of light unit 20 with the essential feature being the provision of a strobe light or strobe flash light source together with a source of directed light energy similar to a conventional flash light. It will be apparent to those skilled in the art that a variety of light unit apparatus may be provided to carry forth the operation of the present invention image making toy.

More specifically, FIG. 3 sets forth a partially sectioned front view of light unit 20. As described above, light unit 20 includes an elongated housing 21 defining an interior cavity 35. A directed light beam source 40 includes a removable cap 48 secured to the lower end of housing 21 and a conventional socket 44 and light reflector assembly 46 supported within interior cavity 35 of housing 21. A transparent faceplate 47 is secured against reflector 46 by the attachment of cap 48 to housing 21. A conventional electric bulb 45 such as a conventional flash light lamp is received within socket 44 and reflector 46 in accordance with conventional fabrication techniques. As is better seen in FIG. 5, housing 21 supports a plurality of batteries such as batteries 56 and 57. By means not shown but in accordance with conventional fabrication techniques, socket 44 is electrically coupled to batteries 56 and 57.

An electrical switch 34 is operatively coupled between socket 44 and batteries 56 and 57 by conventional wiring means (not shown). A light beam button 26 is movably supported by housing 21 and is operable to manipulate switch 34. Thus, light beam button 26 is operative by inward movement or depression in the direction indicated by arrow 70 to actuate switch 34 and provide selective coupling or decoupling between bulb 45 and batteries 56 and 57. When energized, bulb 45 produces long duration light energy which is generally focused or directed by reflector 46 outwardly through faceplate 47 in the form of a generally focused light beam such as light beam 41 shown in FIG. 2. With light beam button 26 released, switch 34 is open circuit and bulb 45 remains inoperative.

Housing 21 further defines a recess 36 which receives a movable on/off button 25 in conventional attachment. A conventional slide switch 27 is supported within interior cavity 35 of housing 21 by conventional attachment means (not shown) and is operatively coupled to slide switch 27. Thus, as on/off button 25 is moved within recess 36 in the directions indicated by arrows 71, slide switch 27 is moved between a closed circuit and open circuit configuration. Housing 21 further supports a generally cylindrical strobe lens 50 formed of a transparent plastic material or the like. As is better seen in FIG. 4, an elongated strobe discharge tube 51 is supported behind strobe lens 50 using conventional fabrication techniques.

A generally spherical lens 19 which may for example be formed of a transparent red plastic material or the like is secured to the upper surface of housing 21 and receives a strobe indicator lamp 22. Lamp 22 may, in its preferred form, comprise a conventional neon-type bulb or the like and is coupled to strobe circuit 55 (seen in FIG. 5) by a pair of electrical connectors 58 and 59 in accordance with conventional fabrication techniques.

Housing 21 further defines an aperture 32 which receives an elongated strobe trigger button 23. Button 23 is pivotally secured within housing 21 by a pivot 28. A spring metal contact 29 is secured to strobe trigger button 23 in accordance with conventional fabrication techniques and is operative to urge strobe trigger button 23 outwardly from housing 21. Button 23 includes an extending tab 33 which extends beyond aperture 32 of housing 21 and limits the outward motion of button 23. A plurality of aesthetic elements 45 which provide no functional activity but rather are limited to improving the appearance of light unit 20 are supported upon housing 21.

In operation, on/off button 25 is moved to the on position to couple strobe circuit 55 (seen in FIG. 5) to batteries 56 and 57 to energize strobe circuit 55. It will be apparent to those skilled in the art that while the wiring connections between slide switch 21 and strobe circuit 55 and batteries 56 and 57 is omitted from FIGS. 3 through 5, such wiring connection is in accordance with conventional fabrication techniques. The energizing of strobe circuit 55 produces sufficient energy for the activation of strobe discharge tube 51. The user is able to trigger the production of a strobe light discharge by applying an inward force in the direction of arrow 72 against strobe trigger button 23 overcoming the force of spring contact 29. Contact 29 is brought into electrical contact with connector 58 to trigger strobe firing and to couple the electrical energy from circuit 55 to strobe discharge tube 51 and produce a burst of light energy. Prior to the actuation of strobe trigger button 23, the readiness of strobe circuit 55 is indicated by the glowing action of strobe indicator 22. In accordance with conventional fabrication techniques, strobe circuit 55 operates following the firing of the strobe discharge tube to recycle and prepare for the next strobe light firing. Once the preparation is complete, strobe indicator 22 again glows indicating strobe readiness.

As an alternative to producing a strobe light energy burst, the user is also able to press light beam button 26 inwardly to operate switch 34 and thereby couple bulb 45 to batteries 56 and 57 producing the above-described directed or focused light beam. In this mode, the user is able to undertake the "writing or drawing" action described above in FIG. 2 upon luminescent screen 12. Once this activity is complete, the user again presses light beam button 26 turning off switch 34 and terminating the light beam action.

FIG. 4 sets forth a partially sectioned side view of light unit 20. As described above, light unit 20 includes a housing 21 supporting a removable cap 48 at the lower end thereof and defining an aperture 32. As is also described above, a strobe trigger button 23 is pivotally supported within aperture 32. Light unit 20 further includes a strobe indicator 22 at the upper end thereof and a plurality of aesthetic elements 45. A strobe lens 50 is supported upon the frontal face of housing 21 in accordance with conventional fabrication techniques. An elongated reflector 52 is supported behind strobe lens 50 and encloses a strobe discharge tube 51. Reflector 52 and discharge tube 51 are supported within interior cavity 35 of housing 21 using conventional fabrication techniques (not shown). Also not shown in FIG. 4 are the conventional wiring connections which couple strobe discharge tube 51 to strobe circuit 55 (seen in FIG. 5).

FIG. 5 sets forth a section view of light unit 20 taken along section lines 5—5 in FIG. 3. Light unit 20 includes a housing 21 defining an interior cavity 35 and supporting a directed light beam button 26. A conventional strobe circuit 55 is supported within interior cavity 35 together with a plurality of batteries such as batteries 56 and 57. Once again, it will be apparent to those skilled in the art that the operative electrical connections between batteries 56 and 57 and strobe circuit 55 have been omitted from FIG. 5 but should be understood to be provided in accordance with conventional fabrication techniques.

What has been shown is a luminescent screen image making toy which utilizes a combination light unit together with a luminescent screen to provide a variety of image making capabilities which the user may employ to create a virtually endless variety of screen images. The light unit provides both high intensity short duration strobe light bursts suitable for silhouetting or large area illumination together with a directed light beam similar to a flash light beam suitable for use in a writing or drawing mode upon the luminescent screen.

While particular embodiments of the invention have been shown and described, it will be obvious to those skilled in the art that changes and modifications may be made without departing from the invention in its broader aspects. Therefore, the aim in the appended claims is to cover all such changes and modifications as fall within the true spirit and scope of the invention.

That which is claimed is:

1. A luminescent image making toy comprising:

a luminescent screen defining a luminescent image surface;

a light unit housing defining an interior cavity;

strobe light means for producing a short-duration burst of light energy supported within said interior cavity;

a strobe trigger coupled to said strobe light means;

directed light means for producing a long duration directed beam of light energy supported within said interior cavity; and a directed light control button for operating said directed light means.

2. A luminescent image making toy as set forth in claim 1 wherein said luminescent screen includes a generally planar sheet.

3. A luminescent image making toy as set forth in claim 2 wherein said strobe light means includes a strobe circuit and an elongated strobe discharge tube supported within said housing.

4. A luminescent image making toy as set forth in claim 3 wherein said directed light means includes an electric bulb and a surrounding reflector.

5. A luminescent image making toy as set forth in claim 2 wherein said directed light means includes an electric bulb and a surrounding reflector.

6. A luminescent image making toy as set forth in claim 5 including a battery power source supported within said housing and an on/off switch for activating said strobe light means and said directed light means.

7. A luminescent image making toy comprising:

a luminescent screen having a luminescent imaging surface;

a light unit having strobe means for producing a short duration burst of light energy to illuminate a large portion of said imaging surface and light beam means for producing a long duration directed beam of light for illuminating a small spot area of said imaging surface; and means for operating either said strobe means to silhouette objects upon said imaging surface or said light beam means to create an illumination trail upon said imaging surface.

8. A luminescent image making toy as set forth in claim 7 wherein said luminescent screen includes a generally planar sheet.

* * * * *